US011322106B2

(12) United States Patent
Chen et al.

(10) Patent No.: US 11,322,106 B2
(45) Date of Patent: May 3, 2022

(54) METHOD AND DEVICE FOR CONTROLLING TIMING SEQUENCE, DRIVE CIRCUIT, DISPLAY PANEL, AND ELECTRONIC APPARATUS

(71) Applicants: HEFEI BOE OPTOELECTRONICS TECHNOLOGY CO., LTD., Hefei (CN); BOE TECHNOLOGY GROUP CO., LTD., Beijing (CN)

(72) Inventors: Shounian Chen, Beijing (CN); Dayu Zhang, Beijing (CN); Zhuo Zhang, Beijing (CN)

(73) Assignees: HEFEI BOE OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 643 days.

(21) Appl. No.: 16/341,146

(22) PCT Filed: Aug. 29, 2018

(86) PCT No.: PCT/CN2018/102926
§ 371 (c)(1),
(2) Date: Apr. 11, 2019

(87) PCT Pub. No.: WO2019/091190
PCT Pub. Date: May 16, 2019

(65) Prior Publication Data

US 2021/0358440 A1 Nov. 18, 2021

(30) Foreign Application Priority Data

Nov. 7, 2017 (CN) ..... 201711083480.2

(51) Int. Cl.
*G09G 3/36* (2006.01)

(52) U.S. Cl.
CPC ..... *G09G 3/3677* (2013.01); *G09G 3/3648* (2013.01); *G09G 2310/08* (2013.01);
(Continued)

(58) Field of Classification Search
CPC ... G09G 3/36–3696; G09G 2320/0247; G09G 2340/0435; G09G 2320/0233
See application file for complete search history.

(56) References Cited

U.S. PATENT DOCUMENTS 7,499,043 B2 * 3/2009 Vasqnez ..... G09G 5/005 345/211
8,040,334 B2 * 10/2011 Kim ..... G09G 3/2096 345/204
(Continued)

FOREIGN PATENT DOCUMENTS

CN 101859549 A 10/2010
CN 102044207 B 2/2013
(Continued)

OTHER PUBLICATIONS

PCT International Search Report, Application No. PCT/CN2018/102926, dated Nov. 26, 2018, 6 pages: with English translation.
(Continued)

*Primary Examiner* — Patrick F Marinelli
(74) *Attorney, Agent, or Firm* — Armstrong Teasdale LLP

(57) ABSTRACT

Embodiments of the present disclosure provide a method and a device for controlling a timing sequence, a drive circuit, a display panel, and an electronic apparatus. In this method, a frame scan timing sequence for a display signal may be set according to a frame rate of the display signal, wherein the frame scan timing sequence includes an active period and a blanking period. The frame scan timing sequence may be arranged to increase the active period as the frame rate of the display signal decreases.

18 Claims, 3 Drawing Sheets

(52) U.S. Cl.
CPC ..... *G09G 2320/0233* (2013.01); *G09G 2320/0247* (2013.01); *G09G 2340/0435* (2013.01)

(56) References Cited

U.S. PATENT DOCUMENTS

| | | | | |
|---|---|---|---|---|
| 8,194,065 | B1 * | 6/2012 | Walker | G09G 3/20 345/213 |
| 9,087,473 | B1 * | 7/2015 | Walker | G09G 5/005 |
| 9,240,031 | B1 * | 1/2016 | Wang | G09G 5/00 |
| 10,657,862 | B2 * | 5/2020 | Zhang | G09G 3/20 |
| 10,789,908 | B2 * | 9/2020 | Zhu | G06F 3/14 |
| 10,832,624 | B2 * | 11/2020 | Ahn | G09G 3/3648 |
| 10,902,817 | B2 * | 1/2021 | Koo | G09G 3/3655 |
| 10,909,935 | B2 * | 2/2021 | Koo | G09G 5/006 |
| 10,930,248 | B2 * | 2/2021 | Lin | G09G 5/18 |
| 11,043,184 | B2 * | 6/2021 | An | G09G 5/003 |
| 2007/0279407 | A1 * | 12/2007 | Vasquez | G09G 5/006 345/213 |
| 2008/0158234 | A1 * | 7/2008 | Kim | G09G 3/2096 345/501 |
| 2011/0187700 | A1 * | 8/2011 | Kumakawa | G09G 5/18 345/214 |
| 2014/0055476 | A1 * | 2/2014 | Wang | G06T 1/60 345/547 |
| 2018/0059868 | A1 * | 3/2018 | Brahma | G06F 3/0412 |
| 2018/0174551 | A1 * | 6/2018 | Ansari | G09G 5/12 |
| 2018/0247616 | A1 * | 8/2018 | Glen | G09G 5/395 |
| 2019/0005862 | A1 * | 1/2019 | Zhang | G09G 3/20 |
| 2019/0180713 | A1 * | 6/2019 | Zhu | G09G 5/005 |
| 2019/0206348 | A1 * | 7/2019 | Ahn | G09G 3/3614 |
| 2020/0066215 | A1 * | 2/2020 | Koo | G09G 3/3607 |
| 2020/0082781 | A1 * | 3/2020 | An | G09G 3/20 |
| 2020/0090596 | A1 * | 3/2020 | Oh | G09G 3/36 |
| 2020/0126508 | A1 * | 4/2020 | Kim | G09G 5/008 |
| 2020/0135149 | A1 * | 4/2020 | Lin | G09G 3/3406 |
| 2020/0243012 | A1 * | 7/2020 | Jin | G09G 3/3258 |
| 2020/0335033 | A1 * | 10/2020 | Kim | G09G 3/3674 |
| 2021/0134235 | A1 * | 5/2021 | Koo | G09G 3/3426 |
| 2021/0142758 | A1 * | 5/2021 | Koo | G09G 3/3655 |
| 2021/0272531 | A1 * | 9/2021 | Shin | G09G 3/3677 |
| 2021/0280156 | A1 * | 9/2021 | Mehta | G09G 5/10 |
| 2021/0287595 | A1 * | 9/2021 | An | G09G 3/2092 |
| 2021/0287605 | A1 * | 9/2021 | Wang | G09G 3/2092 |
| 2021/0304681 | A1 * | 9/2021 | Noh | G09G 3/3266 |

FOREIGN PATENT DOCUMENTS

| | | | |
|---|---|---|---|
| CN | 102930839 | A | 2/2013 |
| CN | 104662596 | A | 5/2015 |
| CN | 105321486 | A | 2/2016 |
| CN | 106205460 | A | 12/2016 |
| CN | 107610671 | A | 1/2018 |
| TW | 201335910 | A | 9/2013 |

OTHER PUBLICATIONS

PCT Written Opinion, Application No. PCT/CN2018/102926, dated Nov. 26, 2018, 5 pages.: with English translation of relevant part.
China First Office Action, Application No. 201711083480.2, dated Mar. 5, 2019, 19 pps.: with English translation.
China Second Office Action, Application No. 201711083480.2, dated Aug. 15, 2019, 18 pps.: with English translation.

* cited by examiner

METHOD AND DEVICE FOR CONTROLLING TIMING SEQUENCE, DRIVE CIRCUIT, DISPLAY PANEL, AND ELECTRONIC APPARATUS

CROSS REFERENCE TO RELATED APPLICATIONS

This patent application is a National Stage Entry of PCT/CN2018/102926 filed on Aug. 29, 2018, which claims the benefit and priority of Chinese Patent Application No. 201711083480.2 filed on Nov. 7, 2017, the disclosures of which are incorporated by reference herein in their entirety as part of the present application.

BACKGROUND

The present disclosure relates to the field of display technologies, and more particularly, to a method and a device for controlling a timing sequence, a drive circuit, a display panel, and an electronic apparatus.

At present, liquid crystal display (LCD) panels have become mainstream products in the field of display technologies. The display process of the LCD panels is as follows: a source drive circuit (Source IC) provides, to a data line, a grayscale voltage for a corresponding brightness, and a gate drive circuit (Gate IC) scans a gate of a thin film transistor (TFT). When a transistor is enabled, a voltage of the corresponding data line is supplied to a pixel electrode via the data line and the transistor to charge and discharge a liquid crystal capacitor to form a grayscale, thereby implementing image display.

The display panel may display at different refresh rates. Generally, the refresh rate refers to the number of times of refreshing images by the display panel in unit time, and corresponds to a frame rate of a display signal. When the refresh rate is high, the displayed images have high stability, but power consumption of the display panel is also high. When the refresh rate is low, the displayed images are prone to flickering.

BRIEF DESCRIPTION

Embodiments of the present disclosure provide a method and a device for controlling a timing sequence, a drive circuit, a display panel, and an electronic apparatus.

A first aspect of the present disclosure provides a method for controlling a timing sequence. In this method, a frame scan timing sequence for a display signal may be set according to a frame rate of the display signal, wherein the frame scan timing sequence includes an active period and a blanking period. The frame scan timing sequence may be arranged to increase the active period as the frame rate of the display signal decreases.

In some embodiments of the present disclosure, the frame scan timing sequence may include a clock signal timing sequence. The clock signal timing sequence may be arranged to increase a cycle of a clock signal as the frame rate of the display signal decreases.

In some embodiments of the present disclosure, the frame scan timing sequence may be further set to have a same blanking period for different frame rates.

In some embodiments of the present disclosure, the method may further include storing a correspondence between the frame rate and the frame scan timing sequence.

In some embodiments of the present disclosure, the method may further include first receiving the display signal. Next, the display signal is decoded to obtain the frame rate of the display signal. The frame scan timing sequence for the display signal is acquired according to the frame rate and the stored correspondence between the frame rate and the frame scan timing sequence. Next, the frame scan timing sequence is outputted.

A second aspect of the present disclosure provides a device for controlling a timing sequence. The device may include a processor. The processor may be configured to set a frame scan timing sequence for a display signal according to a frame rate of the display signal, wherein the frame scan timing sequence includes an active period and a blanking period. The frame scan timing sequence may be arranged to increase the active period as the frame rate of the display signal decreases.

In some embodiments of the present disclosure, the frame scan timing sequence may include a clock signal timing sequence. The clock signal timing sequence may be arranged to increase a cycle of a clock signal as the frame rate of the display signal decreases.

In some embodiments of the present disclosure, the frame scan timing sequence may be further set to have a same blanking period for different frame rates.

In some embodiments of the present disclosure, the device may further include a memory. The memory is configured to store a correspondence between the frame rate and the frame scan timing sequence.

In some embodiments of the present disclosure, the memory may be configured to store a table containing the correspondence between the frame rate and the frame scan timing sequence. In addition, the memory also may be configured to store a function between the frame rate and the frame scan timing sequence.

In some embodiments of the present disclosure, the processor also may be configured to receive the display signal, decode the display signal to obtain the frame rate of the display signal, acquire the frame scan timing sequence for the display signal according to the frame rate and the stored correspondence between the frame rate and the frame scan timing sequence, and output the frame scan timing sequence.

A third aspect of the present disclosure provides a drive circuit for a display panel. The drive circuit may include a gate drive circuit and the device for controlling a timing sequence according to the second aspect of the present disclosure. The device may be coupled to the gate drive circuit and may be configured to provide the frame scan timing sequence to the gate drive circuit.

A fourth aspect of the present disclosure provides a display panel. The display panel may include the drive circuit according to the third aspect of the present disclosure.

A fifth aspect of the present disclosure provides an electronic apparatus. The electronic apparatus may include the display panel according to the fourth aspect of the present disclosure.

BRIEF DESCRIPTION OF THE DRAWINGS

To describe the technical solutions of the present disclosure more clearly, the accompanying drawings of the embodiments will be briefly introduced below. It is to be known that the accompanying drawings in the following description merely involve with some embodiments of the present disclosure, but not limit the present disclosure. In the figures.

DETAILED DESCRIPTION

Figure 1:
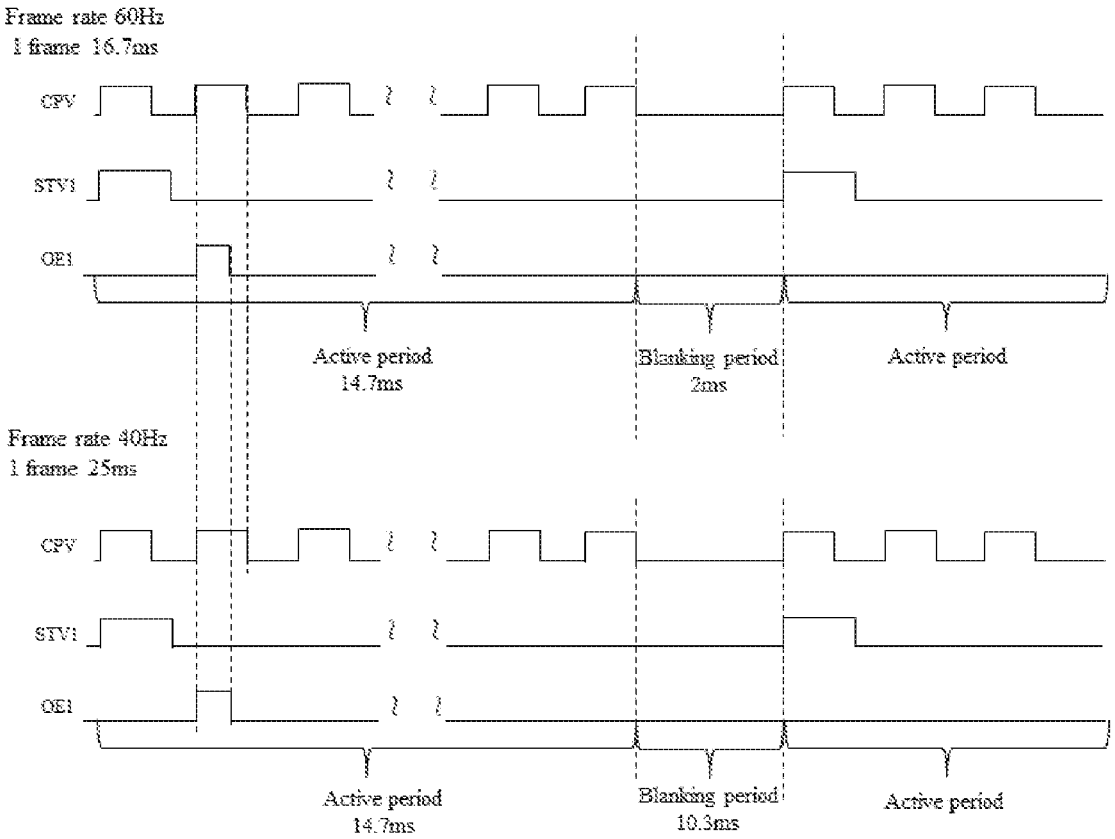
FIG. 1 is an exemplary schematic diagram of a frame scan timing sequence at different frame rates.

To make technical solutions and advantages of the embodiments of the present disclosure clearer, the technical solutions in the embodiments of the present disclosure will be described clearly and completely below, in conjunction with the accompanying drawings. Apparently, the described embodiments are merely some but not all of the embodiments of the present disclosure. All other embodiments obtained by those of ordinary skill in the art based on the described embodiments without creative efforts shall fall within the protection scope of the present disclosure.

Hereinafter, unless otherwise stated, the expression "Component A being coupled to Component B" means that the Component A is directly coupled to the Component B or is indirectly coupled to the Component B through one or more other components.

As used herein, the singular forms "a", "the" and "said" may be intended to include the plural forms as well, unless the context clearly indicates otherwise.

As used herein, the terms "comprising" and "including" specify the presence of the features, integers, steps, operations, elements, and/or components, but do not preclude the presence or addition of one or more other features, integers, steps, operations, elements, components, and/or groups thereof.

As used herein, the term "display signal" refers to a multi-frame image signal, a video signal, an image signal, or the like. The display signal is outputted to a display panel via an element having a display signal output capability, such as a graphics card, an image controller, an image processor, and the like.

As used herein, the term "communication connection" may be implemented through a wired connection, such as by twisted pair, coaxial cable, or fiber optic transmission, or may be implemented through wireless connection, such as Bluetooth, Zigbee, Wi-Fi, or the like.

As used herein, the processor may be a device having a data processing capability and/or program execution capability, for example, a central processing unit (CPU), or a graphics processing unit (GPU), or a field programmable gate array (FPGA), or a digital signal processor (DSP), or a microprogrammed control unit (MCU), etc.

As used herein, the memory may include one or more volatile memories and/or non-volatile memories. The volatile memories may include, for example, a random access memory (RAM) and/or a cache and the like. The non-volatile memories may include, for example, a read only memory (ROM), a hard disk, an erasable programmable read only memory (EPROM), a USB memory, a flash memory, and the like. One or more operation instructions, one or more application programs or various data, such as, data used and/or generated by the application programs, operation instructions, or the like, may be stored on the memory. The memory may be either provided individually, or provided together with a register, a cache and the like in the processor. Furthermore, a register in a display panel driving circuit may also be configured as the memory.

Generally, a gate drive circuit may scan a transistor TFT according to a frequency of a display signal provided by a timing sequence controller TCON. Herein, the frequency of the display signal is the frequency of refreshing images by the display panel (also known as frame rate), indicating the number of frames displayed per second. As the frame rate of the display signal is n hertz (Hz), the time of one frame is (1/n) second(s). For example, for the display signal corresponding to a frame rate of 60 Hz, the time of one frame is 16.7 ms.

It is to be understood that different frame rates may correspond to different frame scan timing sequences. The frame scan timing sequence of the display signal includes an active period and a blanking period. In the active period, the liquid crystal capacitor can be charged, whereas in the blanking period, the liquid crystal capacitor can be discharged.

Generally, for different frame rates, time length of the active period in the frame scan timing sequence remains constant, whereas time length of the blanking period varies accordingly. That is, with respect to a display signal having a higher frame rate, a display signal having a lower frame rate has a longer blanking period of the frame scan timing sequence. For reducing the power consumption of the display panel, a static image may be typically displayed in a lower frame rate. However, at a lower frame rate, the blanking period of the frame scan timing sequence is too long, resulting in a longer discharging time (holding time) of the liquid crystal capacitor. A single pixel voltage of the display panel cannot be held. Therefore, images of the display panel become darker at a lower frame rate, thereby producing a flickering phenomenon and causing a brightness difference of a same image at different frame rates.

FIG. 1 illustrates an exemplary schematic diagram of a frame scan timing sequence at different frame rates. The frame scan timing sequence includes a timing sequence of a clock signal CPV, a timing sequence of a frame synchronization signal STV, and a timing sequence of an enable signal OE1. The frequency of the frame synchronization signal STV corresponds to the frame rate of the display signal. The enable signal OE1, which is a control signal outputted from the gate drive circuit, controls the on/off of the transistor TFT together with the clock signal CPV.

As shown in FIG. 1, when the frame rate is 60 Hz, the time length of one frame is 16.7 ms, wherein the active period is 14.7 ms and the blanking period is 2 ms. When the frame rate is reduced to 40 Hz, the time length of one frame is 25 ms, wherein the active period remains 14.7 ms, but the blanking period is increased to 10.3 ms. Since the time length of the active period remains unchanged, the cycle of each signal (for example, the cycle of the clock signal CPV) remains unchanged at different frame rates. That is, the charging time of the liquid crystal capacitor remains unchanged. However, when the frame rate is lower, since the blanking period is too long, the discharging time of the liquid crystal capacitor is too long and a display brightness of an image becomes darker, which is prone to producing the flickering phenomenon.

For this reason, in some embodiments of present disclosure, the charging time and the holding time of the pixel electrode are controlled by setting the frame scan timing sequence corresponding to different frame rates, which is described in detail below.

Figure 2:
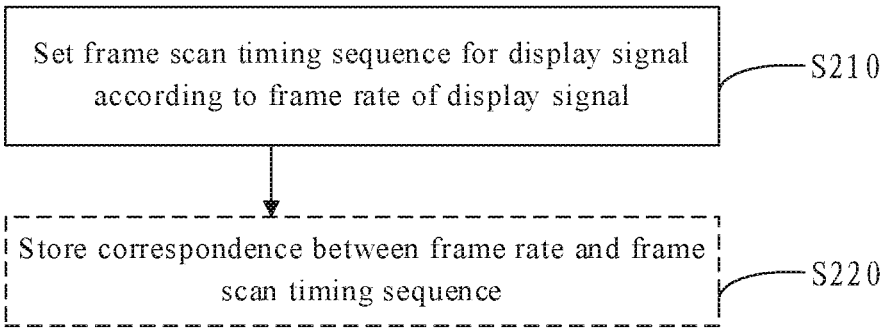
FIG. 2 is a schematic flow chart of a method for controlling a timing sequence according to an embodiment of the present disclosure.

FIG. 2 illustrates a schematic flow chart of a method for controlling a timing sequence according to an embodiment of the present disclosure. As shown in FIG. 2, firstly in Step S210, a frame scan timing sequence for a display signal is set according to a frame rate of the display signal. In some embodiments, the frame scan timing sequence is arranged to increase the time length of the active period as the frame rate of the display signal decreases. That is, with respect to a display signal having a higher frame rate, a display signal having a lower frame rate has a longer active period of the frame scan timing sequence. Therefore, the time length of the blanking period is relatively reduced, the discharging time of a capacitor in the display panel driving circuit is correspondingly reduced, and the voltage of the pixel electrode may be held.

When a correspondence between the frame rate of the display signal and the frame scan timing sequence is set for the first time, the correspondence between the frame rate and the frame scan timing sequence may be stored in Step S220 after Step S210.

After the frame rate and the frame scan timing sequence are stored correspondingly, the frame scan timing sequence corresponding to the frame rate may be looked up for subsequent display.

For example, the frame scan timing sequence corresponding to the frame rate of 10 Hz is stored as the timing sequence K0, and the frame scan timing sequence corresponding to the frame rate of 60 Hz is stored as the timing sequence K70, and the like. Table 1 schematically illustrates the frame scan timing sequences corresponding to different frame rates (for example, 10 Hz-60 Hz).

TABLE 1

| Frame rate (Hz) | Timing sequence |
|---|---|
| 10 | K0 |
| 11 | K1 |
| . . . | . . . |
| 59 | K69 |
| 60 | K70 |

For example, the correspondence between the frame rate p and the frame scan timing sequence K may be expressed as a function K=f(p) by mathematical fitting and statistical sampling methods, etc., and may be stored. Then, the stored function may be called for the frame rate p to determine the frame scan timing sequence K corresponding to the frame rate p.

In some embodiments of the present disclosure, the frame scan timing sequence may be set to have a same blanking period for different frame rates.

Figure 3:
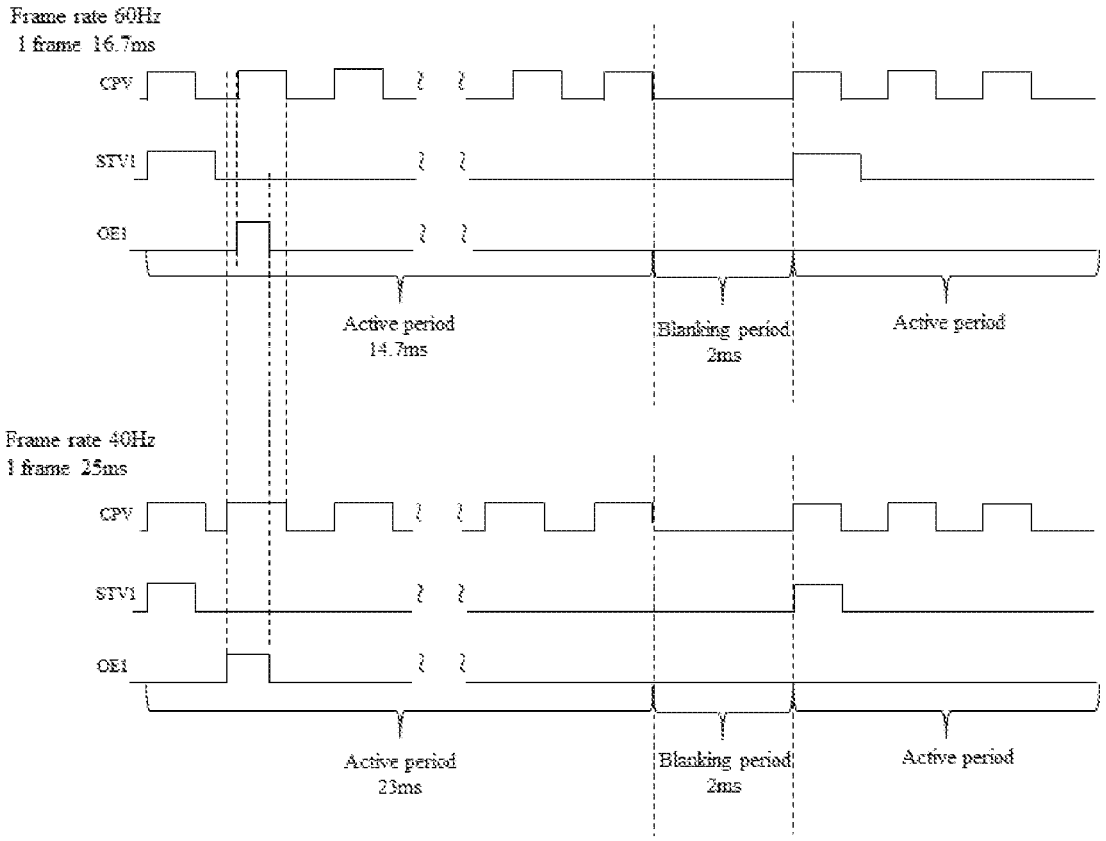
FIG. 3 is a schematic diagram of a frame scan timing sequence at different frame rates according to an embodiment of the present disclosure.

FIG. 3 illustrates a schematic diagram of a frame scan timing sequence at different frame rates according to an embodiment of the present disclosure. When the frame rate of the display signal is 60 Hz, the time length of one frame is 16.7 ms, wherein the active period is 14.7 ms, and the blanking period is 2 ms. When the frame rate is reduced to 40 Hz, the time length of one frame is 25 ms, wherein the blanking period remains 2 ms, whereas the active period is increased to 23 ms. Therefore, during low frequency scanning (i.e., at a lower frame rate), the blanking period of the frame scan timing sequence is the same, the discharging time of a capacitor in the drive circuit remains unchanged, the voltage of the display electrode is held, and thus the brightness of an image can be better sustained.

In some embodiments of the present disclosure, in the process of setting the frame scan timing sequence, the timing sequence of the clock signal CPV may be set such that the cycle of the clock signal CPV increases as the frame rate of the display signal decreases. As shown in FIG. 3, with respect to a clock signal timing sequence corresponding to the frame rate of 60 Hz, a cycle of a clock signal in a clock signal timing sequence corresponding to the frame rate of 40 Hz is longer. Therefore, the charging time of a capacitor in the drive circuit is increased to reduce the brightness variation for an image.

Figure 4:
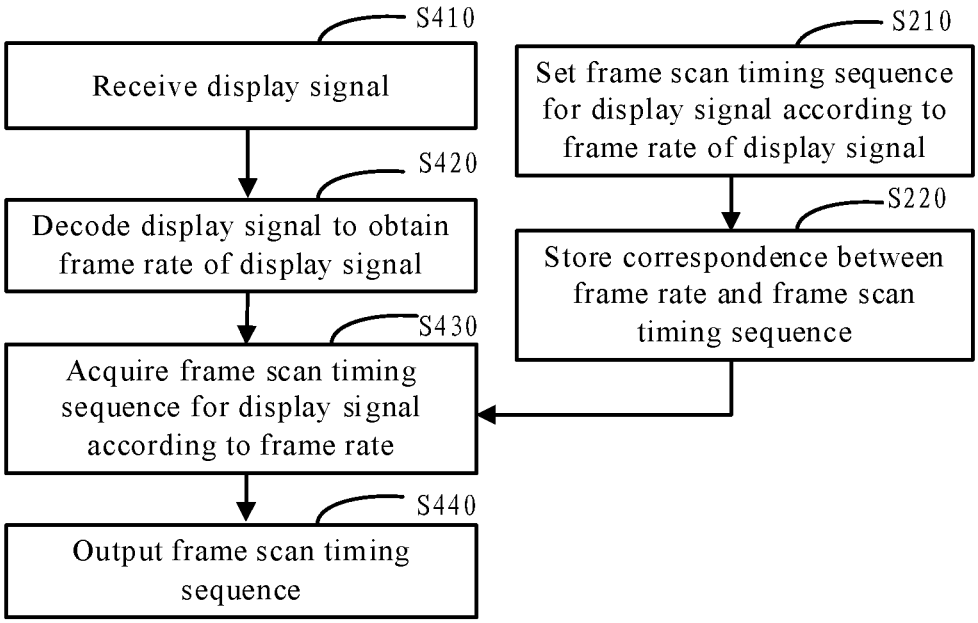
FIG. 4 is a schematic flow chart of a method for controlling a timing sequence according to another embodiment of the present disclosure.

FIG. 4 illustrates a schematic flow chart of a method for controlling a timing sequence according to another embodiment of the present disclosure. When a system transmits the display signal, the display signal is received in Step S410. The display signal includes the frame rate (i.e., a refresh rate of the display panel), a resolution, image information, and the like. In Step S420, the received display signal is decoded to obtain the frame rate of the display signal. The frame scan timing sequence for the display signal is acquired in Step S430 according to the frame rate obtained in Step S420 and the correspondence between the frame rate and the frame scan timing sequence stored in Step S220. Then, in Step S440, the acquired frame scan timing sequence is outputted, such that the turned-on/turned-off time of the transistor TFT is controlled to control the charging and discharging time of the capacitor in the drive circuit.

As an example, when the display signal is decoded to determine a frame rate of 11 Hz, the stored control timing sequence K1 corresponding to the frame rate is called according to Table 1. According to the timing sequence K1, the transistor TFT is controlled to be charged and discharged via the source drive circuit (Source IC) and the gate drive circuit (Gate IC) according to the frame scan timing sequence set corresponding to 11 Hz.

According to some embodiments of the present disclosure, the above method for controlling a timing sequence can avoid occurrence of a low frequency flickering phenomenon and reduce brightness difference of the same image at different frame rates.

Figure 5:
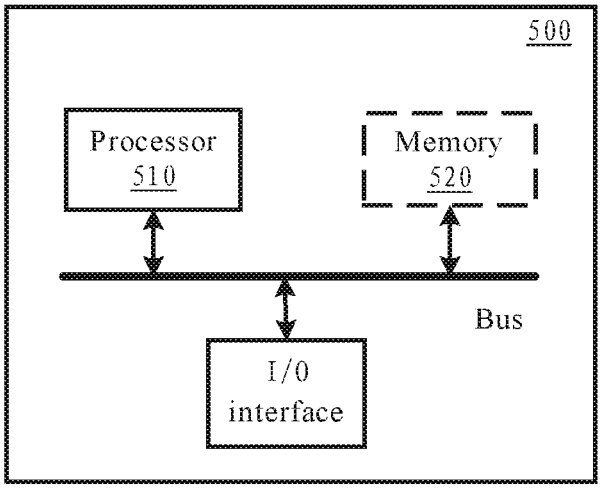
FIG. 5 is a schematic block diagram of a device for controlling a timing sequence according to an embodiment of the present disclosure.

FIG. 5 illustrates a schematic block diagram of a device 500 for controlling a timing sequence according to an embodiment of the present disclosure. As shown in FIG. 5, the device 500 includes one or more processors 510. Alternatively, the device 500 also includes a memory 520, which is communicatively coupled to the processor 510. For example, the memory 520 is coupled to an I/O interface of the processor via a bus.

In some embodiments of the present disclosure, the processor 510 may set a frame scan timing sequence for a display signal according to a frame rate of the display signal, wherein the frame scan timing sequence includes an active period and a blanking period. The memory 520 may store a correspondence between the frame rate and the frame scan timing sequence. For example, the memory may be configured to store a table containing the correspondence between the frame rate and the frame scan timing sequence. In addition, the memory may also be configured to store a function between the frame rate and the frame scan timing sequence. In some embodiments, the frame scan timing sequence is set such that the active period increases as the frame rate of the display signal decreases.

In the process of setting the frame scan timing sequence by the processor 510, the clock signal timing sequence may be set such that a cycle of a clock signal increases as the frame rate of the display signal decreases.

In addition, the processor 510 may further set the frame scan timing sequence to have a same blanking period for different frame rates.

In some embodiments of the present disclosure, the processor 510 may also read the display signal. In an embodiment, the processor 510 may receive the display signal and decode the display signal to obtain a frame rate of the display signal. Then, the processor 510 may retrieve, according to the frame rate, the frame scan timing sequence for the frame rate of the display signal from the memory 520, and then may output the frame scan timing sequence, thereby controlling the gate drive circuit to scan a transistor.

In another embodiment of the present disclosure, the processor may acquire, from other external devices, the correspondence between the frame rate of the display signal and the frame scan timing sequence, rather than the memory. For example, a drive program of a graphics processing unit (GPU) may be programmed to output, according to an acquired extended display identification data (i.e., EDID data) of the display panel, the display signal based on the correspondence between the frame rate associated with the display signal and the frame scan timing sequence. The processor performs corresponding display according to the acquired GPU drive information by controlling a drive circuit of the display panel.

Figure 6:
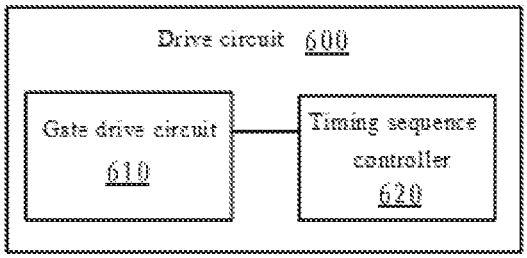
FIG. 6 is a schematic block diagram of a drive circuit according to an embodiment of the present disclosure.

FIG. 6 illustrates a schematic block diagram of a drive circuit 600 according to an embodiment of the present disclosure. As shown in FIG. 6, the drive circuit 600 may include a gate drive circuit (Gate IC) 610 and a timing sequence controller (TCON) 620, wherein the timing sequence controller 620 may be implemented by the above device 500. In the drive circuit 600, the timing sequence controller 620 is coupled to the gate drive circuit 610 and provides the frame scan timing sequence to the gate drive circuit 610.

According to an embodiment of the present disclosure, there is also provided a display panel, which includes the above drive circuit 600 and a display circuit.

The display panel may be, for example, a liquid crystal display (LCD) panel, an organic light-emitting diode (OLED) display panel, and the like.

In addition, an embodiment of the present disclosure also provides an electronic apparatus including the display panel. The electronic apparatus may be, for example, a mobile phone, a tablet computer, a display screen, a wearable apparatus, or the like.

Though a plurality of embodiments of the present disclosure are described in detail above, the scope of protection of the present disclosure is not limited thereto. Apparently, those of ordinary skill in the art may make various modifications, substitutions, and variations on the embodiments of the present disclosure without departing from the spirit and scope of the present disclosure. The scope of protection of the present disclosure is limited by the appended claims.

What is claimed is:

1. A method for controlling a timing sequence, the method comprising:

setting a frame scan timing sequence for a display signal according to a frame rate of the display signal, the frame scan timing sequence comprising an active period and a blanking period;

wherein the frame scan timing sequence is arranged to increase the active period as the frame rate of the display signal decreases, and wherein the frame scan timing sequence is further set to have a same blanking period for different frame rates.

2. The method according to claim 1, wherein the frame scan timing sequence comprises a clock signal timing sequence, and wherein the clock signal timing sequence is arranged to increase a cycle of a clock signal as the frame rate of the display signal decreases.

3. The method according to claim 1, further comprising:

storing a correspondence between the frame rate and the frame scan timing sequence.

4. The method according to claim 3, further comprising:

receiving the display signal;

decoding the display signal to obtain the frame rate of the display signal;

acquiring the frame scan timing sequence for the display signal according to the frame rate and the stored correspondence between the frame rate and the frame scan timing sequence; and outputting the frame scan timing sequence.

5. A device for controlling a timing sequence, the device comprising:

a processor configured to set a frame scan timing sequence for a display signal according to a frame rate of the display signal, the frame scan timing sequence comprising an active period and a blanking period, wherein the frame scan timing sequence is arranged to increase the active period as the frame rate of the display signal decreases, and wherein the frame scan timing sequence is further set to have a same blanking period for different frame rates.

6. The device according to claim 5, wherein the frame scan timing sequence comprises a clock signal timing sequence, and wherein the clock signal timing sequence is arranged to increase a cycle of a clock signal as the frame rate of the display signal decreases.

7. The device according to claim 5, further comprising a memory communicatively coupled to the processor and configured to store a correspondence between the frame rate and the frame scan timing sequence.

8. The device according to claim 7, wherein the memory is configured to store one of i) a table containing the correspondence between the frame rate and the frame scan timing sequence, and ii) function between the frame rate and the frame scan timing sequence.

9. The device according to claim 7, wherein the processor is further configured to:

receive the display signal;

decode the display signal to obtain the frame rate of the display signal;

acquire the frame scan timing sequence for the display signal according to the frame rate and the stored correspondence between the frame rate and the frame scan timing sequence; and output the frame scan timing sequence.

10. A drive circuit for a display panel comprising:

a gate drive circuit; and the device for controlling a timing sequence according to claim 5, the device coupled to the gate drive circuit and configured to provide the frame scan timing sequence to the gate drive circuit.

11. A display panel comprising the drive circuit according to claim 10.

12. An electronic apparatus comprising the display panel according to claim 11.

13. The method according to claim 2, wherein the frame scan timing sequence is further set to have a same blanking period for different frame rates.

14. The drive circuit according to claim 10, wherein the frame scan timing sequence comprises a clock signal timing sequence, and wherein the clock signal timing sequence is arranged to increase a cycle of a clock signal as the frame rate of the display signal decreases.

15. The drive circuit according to claim 10, wherein the frame scan timing sequence is further set to have a same blanking period for different frame rates.

16. The drive circuit according to claim 10, wherein the device for controlling a timing sequence further comprises a memory communicatively coupled to the processor and configured to store a correspondence between the frame rate and the frame scan timing sequence.

17. The drive circuit according to claim 16, wherein the memory is configured to store one of i) a table containing the correspondence between the frame rate and the frame scan timing sequence, and ii) a function between the frame rate and the frame scan timing sequence.

18. The drive circuit according to claim 16, wherein the processor is further configured to:

receive the display signal;

decode the display signal to obtain the frame rate of the display signal;

acquire the frame scan timing sequence for the display signal according to the frame rate and the stored correspondence between the frame rate and the frame scan timing sequence; and output the frame scan timing sequence.

* * * * *